United States Patent [19]

Clemens

[11] 4,007,699

[45] Feb. 15, 1977

[54] METHOD AND APPARATUS FOR A DIFFERENTIAL ROLLING-IN OF TUBES

[75] Inventor: Kurt Clemens, Gummersbach, Germany

[73] Assignee: L. & C. Steinmuller GmbH, Gummersbach, Germany

[22] Filed: Feb. 20, 1975

[21] Appl. No.: 551,257

Related U.S. Application Data

[63] Continuation-in-part of Ser. No. 329,610, Feb. 5, 1973, abandoned.

[30] Foreign Application Priority Data

Feb. 4, 1972 Germany ..... 2205281

[52] U.S. Cl. ..... 113/118 C; 29/157.4; 29/727; 72/10; 72/29; 72/377; 113/1 C

[51] Int. Cl.[2] ..... B21D 53/02

[58] Field of Search ..... 113/1 C, 118 C; 29/202 R, 202 D, 208 R, 208 C, 208 D, 157.4; 72/7, 10, 28, 29, 122, 125, 126, 367, 370, 377, 393, 457, DIG. 4

[56] References Cited

UNITED STATES PATENTS

| | | | |
|---|---|---|---|
| 1,516,704 | 11/1924 | Braun | 29/202 D |
| 2,690,205 | 9/1954 | Stary | 29/202 D |
| 3,349,465 | 10/1967 | LaPan et al. | 29/157.4 X |
| 3,449,812 | 6/1969 | Hauschke et al. | 29/157.4 |
| 3,585,701 | 6/1971 | Stary | 29/202 D |
| 3,628,227 | 12/1971 | Blackburn et al. | 29/202 D X |
| 3,718,017 | 2/1973 | Blackburn | 29/202 D X |

*Primary Examiner*—Victor A. DiPalma
*Attorney, Agent, or Firm*—Walter Becker

[57] ABSTRACT

Method and apparatus for differentially rolling-in tubes into plates and walls, especially of heat exchangers, according to which the magnitude of the expansion of the tube section to be rolled-in into the respective wall or plate is predetermined, is ascertained and maintained during the rolling-in action. The magnitude of the tube expansion for connection of the tube to the respective plate or wall is adjustable in conformity with a program and has different values over the rolling-in length of the tube.

17 Claims, 7 Drawing Figures

METHOD AND APPARATUS FOR A DIFFERENTIAL ROLLING-IN OF TUBES

This is a continuation-in-part of co-pending application Ser. No. 329,610-Clemens filed Feb. 5, 1973, now abandoned.

The present invention relates to a method of differentially rolling pipes into tube plates and the like, according to which the magnitude of the expansion for the connection of the pipe to the tube plate is predetermined, is measured during the rolling process, is recorded and is maintained during the rolling operation.

In particular with heat exchangers it is necessary to connect the pipes or tubes tightly in the bores of the tube plate. When the pipes or tubes have to be rolled into the bores, a pipe expander or roller is employed which is introduced into the pipe end to be connected. By means of the rollers of the expander, the running diameter of which is gradually increased, the pipe is expanded until it tightly engages the inner wall of the corresponding bore. However, it is also possible merely to pass an engaging roller through the pipe (slide fit). In this connection a tightness has been realized which is better than when the pipe would have been welded into the tube plate. For determining the extent to which in such instances the pipes have to be expanded, several possibilities have become known. Most widely used is a calculating method according to which the expansion necessary for a tight connection of the pipe is expressed in percent of the wall thickness of the pipes to be rolled-in to the free inner width of the pipes. As a result thereof there is obtained the free inner width of the pipe following the rolling operating. By this method it can be realized that the pipes with identical percentage of the expansion are independently of their diameters and of the tolerances of the bores in the tube plates pressed with the same force against the walls of the bores in the tube plate. However, it is necessary that the tolerances of the tube and bore dimensions as they are customary in connection with the rolling-in operation and the tolerances of the respective employed materials and their strength values are maintained. The magnitude of the percentage of the expansion necessary for the pipe connection depends on the material of the pipes and its properties and on the physical and thermal loads of the devices and is mostly determined empirically.

With all heretofore known rolling methods it is the goal to obtain a uniform expansion of the pipe and, more specifically, over the entire rolling length of the pipe, because it appeared that only then it would be possible to obtain a sufficiently tight connection between pipe and tube plate. This was satisfactory as long as the tube plates were not very thick. In the meantime, however, due to the raised requirements to be met, it became necessary to roll the pipes into even thicker tube plates. In extreme cases, tube plates have been employed which have a thickness of 600 mm. In this connection, however, the difficulty was encountered that with the uniform expansion over the entire height, distortions of the tube plate may result and that the portion of the tube to be rolled-in will during the rolling process increase in length to such an extent that this increase can no longer be neglected. Such an increase in the length of the pipe brings about that, for instance, pipes unilaterally welded to the plate will become detached again or that the pipes will bend in the interior of the heat exchanger.

Surprisingly it has been found that these drawbacks can be avoided and that the increase in length of the pipe portions to be rolled-in can be considerably reduced while nevertheless the tightness is still fully assured and meets the highest requirements.

It is an object of the present invention to provide a method of and device for rolling pipes into a tube plate or the like which will overcome the above mentioned drawbacks and according to which the magnitude of the pipe expansion for assuring a tight connection is adjustable in conformity with a program and has different values over the length of the rolling-in section.

This object and other objects and advantages of the invention will appear more clearly from the following specification in connection with the accompanying drawings, in which.

The method according to the present invention is characterized primarily in that the magnitude of the expansion for effecting a tight connection is adjustable in conformity with a program and has different values over the length of the rolling-in section.

Before referring in detail to the accompanying drawings, it may be necessary to point out that the illustrated examples all refer to the same rolling-in length of 200 mm in order to permit a better comparison of these examples with each other. Inasmuch as the expansion is independent of the pipe diameter, it was possible to diagrammatically illustrate the changes on the inner wall of the pipe as caused by the rolling operation. The kind of method used in connection with the rolling operation is immaterial as far as the invention is concerned, inasmuch as the reciprocating rolling process or the stepwise rolling may be employed, the rolling-in method to be selected depending on the respective requirements.

Figure 1:
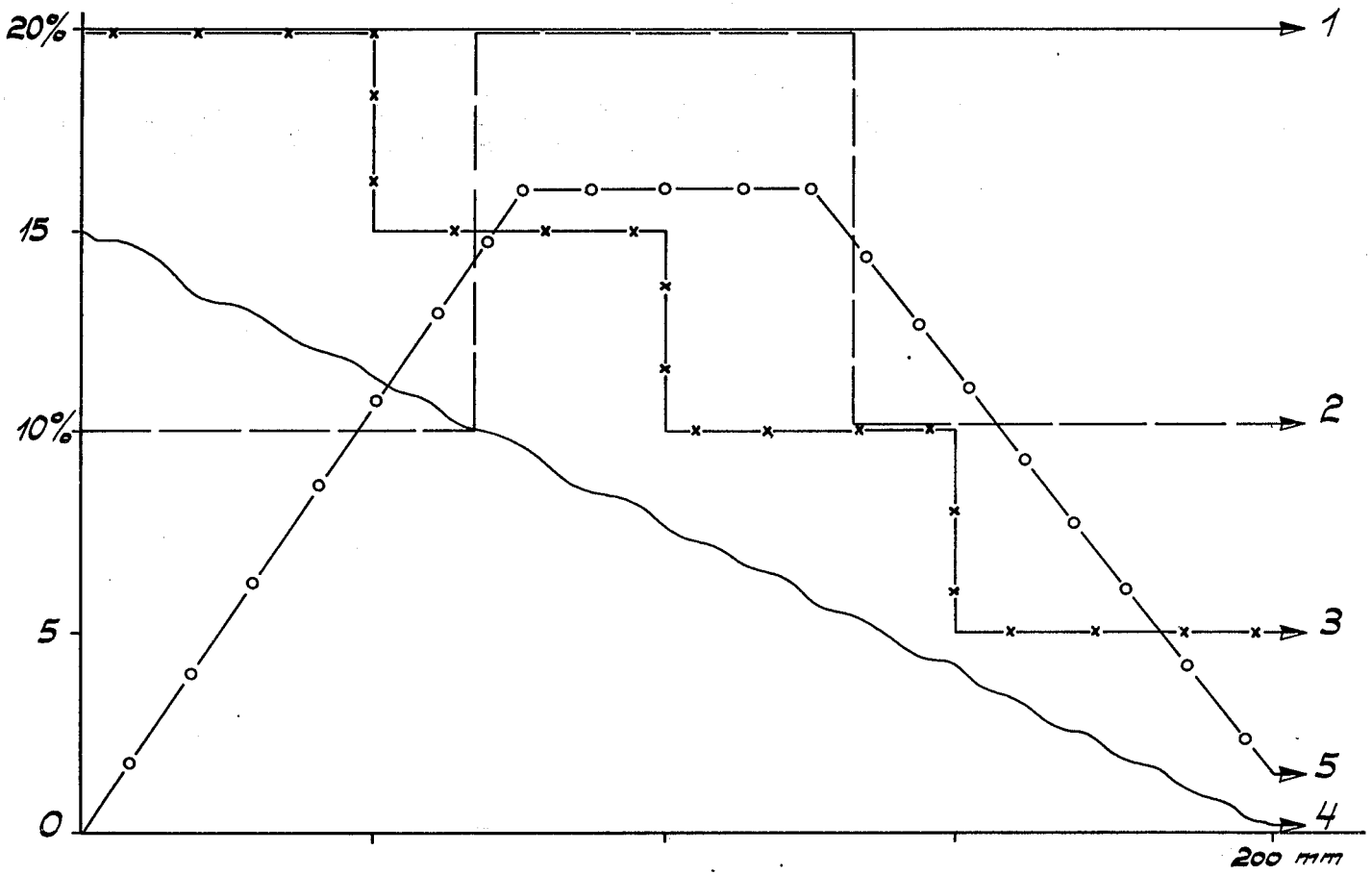
FIG. 1 represents a diagram in which several programs for different pipe expansion methods according to the invention are shown.

Referring now to the drawings in detail, curve 1 of FIG. 1 represents the heretofore known customary rolling while over the entire length of the rolling-in section of, for instance, 200 mm in the present example a uniform expansion of 20% is maintained. This results in a deformation of the pipe in conformity with FIG. 2. In this instance the critical point is located at the exit of the pipe 11 from the tube plate 12 because here the transition area 13 between the rolled and thereby consolidated portion 14 of the pipe and the non-rolled and thereby non-machined portion of the pipe is located. At this area not only tears due to stresses may occur but also intercrystalline corrosion may result.

Figure 3:
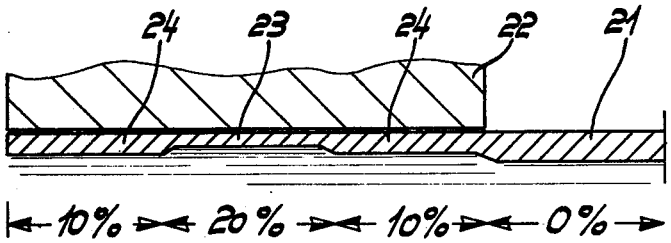

If, in contrast thereto, according to curve 2 of FIG. 1 the rolling is effected in conformity with a program according to which the first third of the rolling area is rolled, for instance, with 10%, the second third is rolled with 20% and the last third is rolled with 10% of the total expansion for a tight connection, it will be appreciated that over the entire length of the rolling section a tight fit will be realized while, as will be evident from FIG. 3, at the exit of the pipe 21 from the tube plate 22 there is obtained a considerably smaller difference in wall thickness, because in this instance only a difference between an expansion of 0% and an expansion of 10% prevails. Nevertheless the pipe is completely tight because here at the rolling area 23 a pipe expansion of 20% prevails while at both sides the rolling areas 24 respectively have a pipe expansion of 10% which is still sufficient to assure a tight fit of the pipe.

Figure 4:
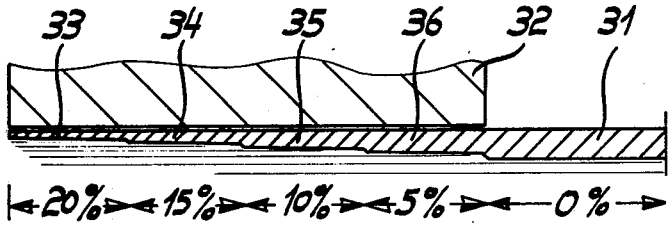

In certain instances it may also be highly advantageous to carry out the rolling operation over a rolling-in section in conformity with curve 3 of FIG. 1, i.e. to divide the rolling-in length into four areas of different pipe expansion. According to FIG. 4, pipe 31 is rolled into tube plate 32 in such a way that the first rolling area or section 33, the length of which corresponds approximately to one-fourth of the thickness of the tube plate 32, in other words to the rolling-in length, is rolled in with a pipe expansion of 20%, whereas the next section 34, which likewise corresponds to approximately one-fourth of the total rolling-in length, is rolled in with a pipe expansion of 15%. The next two sections 35 and 36 are then stepped by approximately a further fourth of the total expansion so that the section 35 is rolled-in with 10% and the section 36 is rolled-in with 5% of the pipe expansion. Thus, at the exit of the pipe 31 from the tube plate 32 there prevails only a difference of from 0% to 5% of the pipe expansion whereby a considerable reduction of the stresses at this area is obtained.

Figure 5:
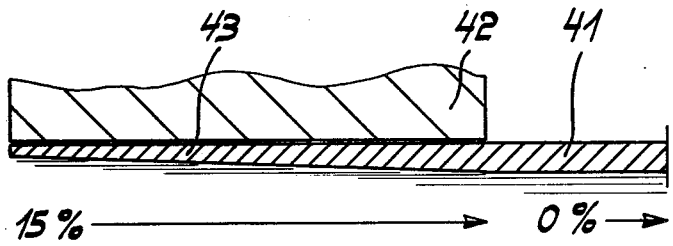

According to the curve 4 of FIG. 1, the magnitude of the pipe expansion is from the start to the end of the rolling-in section reduced continuously from a starting value to zero. This results in a rolling-in area according to FIG. 5 at which the pipe 41 is over the entire rolling-in length, which equals the thickness of the tube plate 42, continuously reduced from 15% to 0%. The pipe section 43 is thus at the rolling-in area deformed conically inwardly so that at the exit of pipe 41 from the tube plate 42 practically no difference in the pipe expansion occurs.

Figure 6:
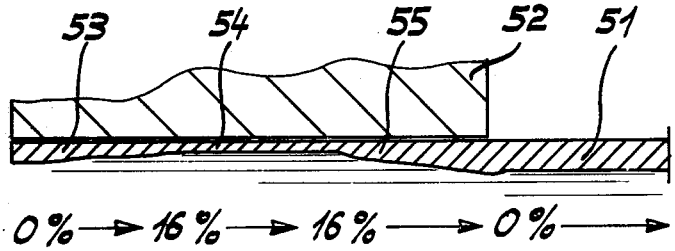
Figure 7:
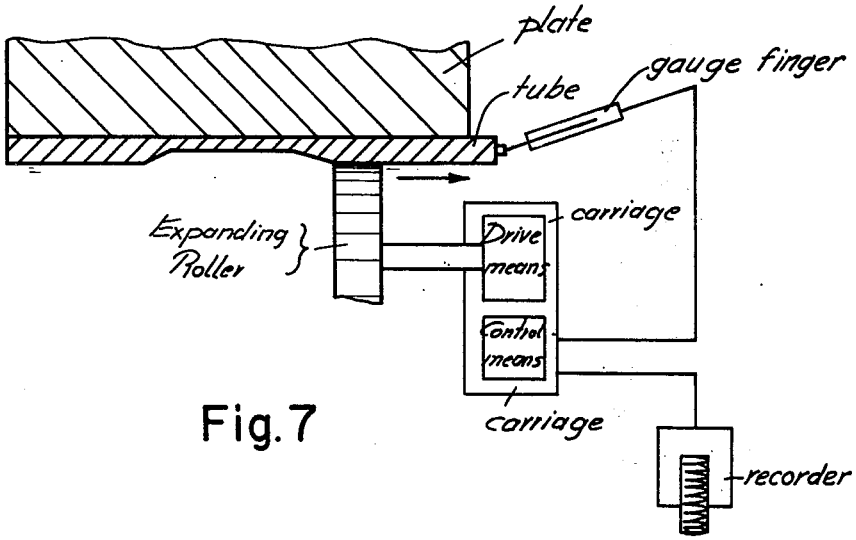
FIG. 7 shows schematically an apparatus for use in carrying out procedure in accordance with the present invention.

According to the curve 5 of FIG. 1, the rolling-in process is effected in conformity with a program which over a certain rolling-in length yields a continuous increase in the pipe expansion from zero to 16%. This maximum value is maintained over a certain length and is then reduced continuously to the end of the rolling-in area to zero. The pertaining cross section of the pipe is illustrated in FIG. 6 according to which the pipe 51 is rolled into the tube plate 52 in such a way that in the first section 53 of the rolling-in portion the pipe expansion is increased from zero to 16% in a continuous manner whereas in the second section 54 the maximum value of the pipe expansion of 16% is maintained. The third section 55 then shows again a continuous decrease in the pipe expansion from 16% to 0% so that also here at the exit area of the pipe 51 from the tube plate 52 no stresses will occur.

A very important further advantage of the method according to the invention is seen in the fact that in the sections in which no full pipe expansion is carried out, the increase in length of the pipe in the rolling-in section is considerably smaller than where the rolling process has to be carried out with full pipe expansion. This new method brings about a more favorable ratio of the increase in length of the pipe to the total length of the pipe, whereby certain drawbacks, such as bending of the pipe or tearing off of the welding seam, can be avoided for all practical purposes. This reduction in increase in the length of the pipe in the rolling-in section makes itself felt in particular when pipes are to be rolled-in which are composed of two different materials. In such instances it was heretofore possible that the softer material got detached because its increase in length was greater than that of the harder material. Also this difficulty has been eliminated by the present invention.

Generally, nowadays the pipe expansion for effecting a tight connection is controlled by the torque of the driving machine by means of which the roller is driven and to which end control devices of standard type may be employed. For carrying out the method according to the present invention, these control devices have to be altered either by providing an additional apparatus or by a new design in such a way that the pipe expansion cannot only be maintained at the once adjusted value, but that it will also be possible to carry out the rolling-in process according to a program.

Inasmuch as according to the heretofore known control devices, the pipe expansion is predetermined or set by an adjusting element, it is, of course, also possible to provide a plurality of adjusting or control elements and to make the same dependent on the depth of penetration of the roller so that each adjusting element corresponds to or has associated therewith a certain section of the total rolling-in length.

With the heretofore known control devices for the electric driving machines of the pipe expanders, the pipe expansion is controlled by a change in the current and in a bridge circuit is compared with an adjustable factor which is adjustable by means of a control element, for instance, a potentiometer. When the current has reached this set value during the rolling operation, the relay either switches off the driving machine or switches it over to left-hand movement, which means a loosening of the pipe roller or expander. After a likewise adjustable intermission period, the next rolling step will start. During the intermission, the step roller can be adjusted as to its rolling depth. The control element associated with the pipe expansion is, for carrying out the method according to the invention, replaced by a plurality of potentiometers which become effective one after the other. In most instances, ten of these resistors are employed so that a rolling operation in ten steps can be carried out. The challenging is effected expediently automatically in conformity with the penetration depth and may be indicated optically when each step has associated therewith a different indicating lamp. By means of a switch it is possible among the ten steps to select any desired number of steps and to adjust or control the same; even though ordinarily a step consists of a right-hand movement of the driving machine up to the pipe expansion, a switch-over to left-hand drive with adjustable duration of such left-hand drive and an adjustable intermission, it is also possible by means of a repeat switch to repeat each step successively for a plurality of times.

It is, however, also possible automatically to adjust or set a single control element in conformity with a certain curve so that by means of this control device the expansion can be carried out in conformity with a desired program over the rolling-in length. It is further possible to combine a small and very simple calculating device with the control device so that the adjustment or setting of the pipe expansion over the length of the rolling-in section will not be effected in steps but continuously in conformity with the respective program. In particular in the last mentioned instance the entire rolling of pipes can be fully automated which results in a considerable technical progress especially for modern heat exchangers with several thousand rolling areas because the rolling operations can be carried out considerably faster while nevertheless with the same precision as heretofore. Also pneumatic driving machines for driving the pipe rollers or expanders can be adapted to the method according to the present invention in a corresponding manner.

In connection with the manufacture of high class heat exchangers it may be expedient to couple a writing instrument with the device for carrying out the method according to the invention. This writing instrument will of each rolling operation record a curve which can then be compared with typical curves of "satisfactory rolling operations". Any deviations from these curves, also of the sequence of the individual steps, indicate whether the rolling-in operations are being properly carried out. This brings about a further improvement in the rolling-in quality.

Summarizing the most important advantages of the method according to the invention, it may be mentioned that the increase in length of the pipe being expanded is considerably reduced while the tightness of the pipe mounting is retained. Furthermore, attacks by corrosion, changes in the structure, the formation of tears in the pipes and the flow conditions can be positively influenced. In addition thereto, the pipe roller or expander can not only with differing pipe expansion, but also with uniform pipe expansion, remain in the respective pipe during the entire rolling operation; as a further advantage, no change of the measuring device has to be effected.

The essence of the present invention can be compared with the state of the art as known at the time the present invention was made. Attention must be directed thereto that previously the rolling of pipes or tubes in the pipe bottoms always occurred thereby that in a bore of the pipe bottom there was a tube stuck in the area of the pipe bottom having pipe rollers engaged against the bore wall means on the inside of the tube or pipe. As a criterion for this rolling, there exist different measures which always must be acknowledged by way of the practical tightness test. There was found, however, that during maintaining of particular values the practical test can be eliminated and still a tight connection of the pipe in the tube or pipe bottom is attained.

Figure 2:
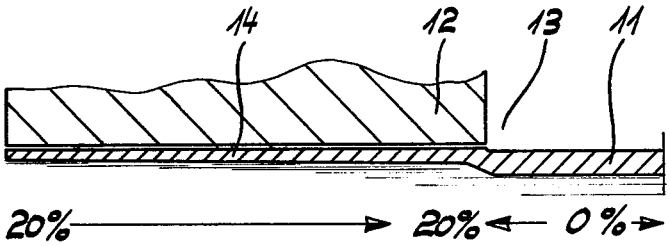
Fig. 2 PRIOR ART
FIGS. 2 through 6 show the respective cross sections of the rolled-in pipe walls as corresponding to the programs shown in FIG. 1.

The most simple fastening of the pipe or tube consists therein that this pipe or tube becomes welded or soldered with the pipe bottom. If also this method in continuous operation has disadvantages, so there is to be attained thereby a very good tightness of the connection of the pipe to the pipe bottom. However, predetermined preconditional measures must be maintained hereby so that the connection becomes optimum. There belongs therewith that the gap between the pipe outer wall and the bore inner wall is so small that soldering means lying there become distributed everywhere as a consequence of the capillary effect so that a good atomic connection results on the surface of the bore inner wall-soldering means and the surface soldering means as to the pipe outer wall. In the U.S. Pat. No. 3,349,465-La Pan et al issued Oct. 31, 1967, there is described such a known method whereby not only a welding of the pipe with the pipe bottom is provided but rather also a type of soldering between the pipe and bore wall of the bore bottom occurs as introduced in an intermediate position between the pipe and pipe bottom which for example can be applied by way of a plating with nickel in a similar type and manner of operation. There is clear, however, that hereby no fastening of the pipe occurs in the bore by way of rolling because expressly after the engaging of the pipe against the bore by way of expansion of the pipe there must be carried out a heat treatment by means of a pipe roller so that there can even be achieved a tight engagement of the pipe against the bore wall. So that now here all transitions can be grasped, there is suggested in FIG. 2 that the pipe should be widened with different thickness. Thereby there is to be achieved that within the rolling length there will exist different conditions or requirements so that with the subsequent heat treatment of the connection at least in the areas of the connection location there is in existence the optimum of requirements for a "solid phase bonding" so that this connection is doubly assured, namely once by way of the welding of the pipe end with the pipe bottom and on the other hand by way of the "soldering" of the pipe in the bore. When hereby the inventor should have brought to realization the concept of the tight rolling of a pipe in a pipe bottom so there would have been necessary neither the welding connection at the end of the pipe nor the soldering connection in the pipe bore. This proves according to belief of the applicant clearly that here the previous inventor neither meant to show or suggest the features of the present invention nor recognized the same but rather the previous inventor wanted to fulfill an entirely different technical conception. For this reason, there is noted that also the different expansion of the pipe means as represented in FIGS. 2 and 3 would not be made obvious nor met from a novelty standpoint also in connection or in combination with other cited references.

The method known from U.S. Pat. No. 3,349,465-La Pan et al accordingly is a step backward as to the method described in the U.S. Pat. Nos. 1,516,704-Braun issued Nov. 25, 1924 and 2,375,235-Maxwell issued May 8, 1945. In both of these patents, there are methods described with which the tightness of a connection location between the pipe and pipe bottom is to be produced only thereby that the pipe is so far rolled in the pipe bore that the same engages with tension against the bore wall whereby then the measure for the enlargement of the pipe inner diameter is assumed or taken as the measurement for the engagement of the pipe outer wall against the bore wall which is used as the criterion for tightness.

Since for the reduction of the pipe wall thickness during rolling there must be applied a force which increased more or less continuously during pipe rolling procedure, there can be utilized the force requirement of the roller as a measure for the tightness of the connection. There has become customary to take this measurement on the drive machine and particularly with an electrical drive machine by way of measuring of the current which is consumed by the machine and with a hydraulic motor by way of a hydraulic pressure which prevails in the supply lines. A third variation of the measurement of this pressure is represented in U.S. Pat. No. 3,585,701-Stary issued June 22, 1971, wherein the conduit T 3 there is measured not the pressure for the rotation of the mandrel but rather the pressure with which this mandrel 19 is advanced in order to press the rolling rollers 4 apart. Also in this case there is measuring in the supply conduit T 3 as to the force with which the pipe 1 is engaged in the bore against the wall means thereof as the pressure in the piston 17 respectively in the supply line T 3.

If also the diagrams in the FIGS. 7 through 10 of U.S. Pat. No. 3,585,701-Stary issued June 22, 1971, appear to represent a method which might be similar to that of the present invention, so attention must be directed to the following factors. At one time in these diagrams the pressure is set forth by way of the time which means at least with respect to the FIGS. 7, 8 and 9 there is an entirely normal rolling described whereby first the pressure is relatively very low because the mandrel spreads the rolling rollers without the same engaging against the pipe. The inclined rise B1, C, D and E now represents that here the rolling rollers have engaged the pipe inner wall means and the pressure with which the rolling rollers become pressed against the pipe wall means increases until the pressure attains the peak X whereby in this moment the rolling rollers expand the pipe as described for instance in column 6, line 53. With the examples according to FIGS. 8 and 9 there is noted that then the mandrel no longer is pressed further into the rolling rollers so that the pressure drops again because a further expansion of the pipe no longer occurs. This is accordingly an entirely normal and today generally conventional rolling of a step whereby after attaining the bonding spread the roller means runs further for a short time and then the mandrel becomes retracted again so that the roller can be withdrawn out of the pipe because the rolling rollers no longer are in engagement with the pipe wall means.

In FIG. 10 there is now described a rolling with which two different values exist. With the location EX and subsequently as to the dotted line EF there is attained the normal bonding spread or widening. Since, however, in the bore in the pipe bottom there are still grooves existing, there must once more be increase as to the pressure of the rolling rollers so that the pipe material flows into these grooves. This results then in the pressure increase EX through EM. During this short time there is increase accordingly as to the pressure above the normal necessary height in order to press the material of the pipe into the grooves. Also this is something completely different than what is to be done with the present inventive method. Such methods are also used today but have the disadvantage that the pipe becomes over-rolled because an essentially greater force is exerted upon the pipe wall means than would be necessary for the necessary tight-rolling.

With the inventive method, however, the pipe or tube never becomes over-rolled but rather the same always is only so far rolled until a tight engagement of the pipe outer wall is provided against the bore inner wall. It is readily clear to the average man skilled in the art that the force with which the pipe can be engaged in the bore against the wall thereof can differ within certain limits so that with low force the tightness is provided at low pressure, whereas with a higher pressure in the heat exchanger also a higher force is necessary for the engagement of the pipe against the bore. Additionally, with this known method according to U.S. Pat. No. 3,585,701-Stary, there is carried out exactly the opposite to that of the inventive method whereby at one time the increase of the bonding-widening force occurs over the time whereas with the inventive method a change of this force occurs over the length of the bore. Thereby, it should be entirely clear for the average man skilled in the art that with this force engagement at one and the same roller location entirely different conditions prevail than when different force engagement is placed one adjacent to another in a pipe roller location. Hereby there cannot be any aid provided according to the suggestion of U.S. Pat. No. 3,349,465-La Pan et al because therein the tightness of the connection does not become achieved by way of the widening of the pipe or tube and thereby the engagement of the pipe or tube against the bore inner wall becomes achieved, but rather the same is achieved exclusively by way of welding and by way of soldering. This method accordingly proceeded in another manner than would be the case with the present invention.

The inventive method has not been previously known because even with the new procedure the force with which the pipe is engaged against the bore in the pipe bottom is different over the length of the bore whereby the tightness without additional aid of special soldering or welding materials can become achieved and whereby as the most important criterion possibly can be stated to involve the force for the widening of the pipe never on the basis of general criterion exceeding the calculated bonding-widening force but rather always having the individual steps located therebelow.

There was additionally established that for instance with the method according to U.S. Pat. No. 3,349,465-La Pan with tubes or pipes of one material which is inclined to intercrystalline corrosion particularly has such a corrosion arising at the location at which the slightest rolling exists and that would mean that approximately at that location at which the pipe projects rearwardly upon the pipe bottom 32, 50 with the FIGS. 2 and 3 there arises the corrosion. This is especially clear in FIG. 2-I as illustrated for the present invention in which the especially endangered zone 13 is lifted out or removed. The zone 13 now with the method according to U.S. Pat. No. 3,349,465-La Pan apparently is displaced into the inside of the pipe bottom approximately to the location 31 with FIG. 2 whereby one must always recognize clearly that there absolutely no rolling-in is provided in the sense of the present invention because the tightness of the roller locations only becomes achieved by way of the intermediate layer between the pipe wall and bore of the pipe bottom after the heat treatment. This tightness becomes further improved by way of the welding at the beginning of the pipe or tube. If this example were to be followed, so the average man would be convicted that such different expansion of the pipe according to the known state of the art is not possible at all without intermediate layering of a soldering layer. The present invention accordingly has contributed an advance in the art in having found a method which makes possible a tight engagement of the pipe against the bore without having necessary any welding at the beginning or any soldering in the bore of the pipe bottom and without endangering by way of corrosion the pipe especially at the exit location out of the pipe bottom. Since the state of the art accordingly followed an entirely different direction, the present invention could neither be obvious nor anticipated by way of this state of the art.

Accordingly, the present invention can be considered to be more special and specific especially involving therein that the tightness of the roller location becomes attained without additional welding or soldering in order thereby to have a clear distinction over the state of the art represented by the U.S. patents cited. Additionally, a different English wording can be sought for the concept "bonding-widening" since the English word "expansion" possibly is not entirely that which is meant here. Normally the term "expansion" means only an expanding of the pipe or tube which, however, only can occur so long until the pipe engages with its outer wall against the bore inner wall. But not until then does the rolling of the pipe occur which, however, is not connected with an expansion but rather whereby only the force becomes increased or enlarged with which the pipe engages against the bore inner wall in order thereby to achieve a tightness. Additionally, no overrolling should become attained as described in the U.S. Pat. No. 3,585,701-Stary but rather that all steps of the rolling-in may not exceed the pre-figured or pre-calculated value of the widening but rather can only exist therebelow. Also this feature is included in the state of the art. One could additionally stress that the rolling should occur over the entire length of the pipe bottom and not within the pipe bottom is there attained the null value as described in U.S. Pat. No. 3,349,465-La Pan. This is particularly to be considered extremely important to the effect that the rolling occurs over the entire range of the pipe piece which is inserted in the bore of the pipe bottom. Only when these features all are met can there be achieved solely by way of rolling-in a tightness of the roller location, in other words, without welding and without soldering which, for instance, is better with the helium test than with the normal welding of the pipe with the pipe bottom. Here the test results suitably can be made available in order to emphasize the value of the present invention. The essential feature remains, however, the fact that with all known methods the susceptibility of the pipe or tube especially of rust-free steel especially at the exit location of the pipe bottom could not be reduced but rather only the same can be achieved with the inventive method. Also test results suitably can be made available for this purpose which become carried out with test rollers for atom reactor construction.

Concerning the term "bonded" there is provided a notation that rolling-in of tubes into the tube bottom possibly could not represent such a connection in the sense of the English wording. Soldering and welding could be such a "connection" between the tube and the tube bottom but probably not the rolling-in of tubes according to the present invention.

The English wording "interference fit" is representative of the crux or pivot point of the entire situation. The U.S. Pat. No. 3,349,465-La Pan et al, in column 4, line 41, sets forth that between the tube material and the bore wall there is to be provided an interference fit. If this concept is interpreted correctly, then this can only mean that after the heat treatment there arises the connection. This connection is, however, not created thereby that the tube becomes so far widened or spread out that a connection or even a "solid phase" connection would have occurred prior to the heat treatment. It is very apparent that particularly at this location in the reference there must be considered that only then has the connection occurred when the connection location is heat treated.

With the present invention, however, the tightness of the connection already is brought about thereby that the pipe or tube is engaged with the outer wall thereof rigidly against the inner wall of the bore without having come to a solid phase connection. Here lies the essential difference with respect to the reference.

In this connection, there is something else that is also very important. With the La Pan et al patent, there is set forth particularly in column 4, lines 3–5, that an interference fit already exists then when between the outer wall of the pipe or tube and the inner wall of the bore there exists a spacing of 0.004 through 0.0012 inch.

Naturally, these values are very small but also there should be realized that with such a spacing between the pipe or tube and the bore there cannot already be attained a tight rolling-in or connection. However, such a small gap between the tube outer wall and the bore inner wall is exactly correct in order to attain a soldering with the intermediate layer as a consequence of capillary effect. Consequently, there is then set forth in column 4, lines 20–30, why different widening or spreading upon should exist namely, in order to obtain with certainty different size gaps between the tube wall and the bore wall so that the optimum requirements for flowing together subsequently during soldering occurring subject to warming and filling out of the gap by way of solder will be fulfilled and will be in existence.

In contrast, however, with the present invention, there is something entirely different that is done, namely, that the pipe is engaged so rigidly against the inner wall of the bore in the tube bottom that no gap exists therewith, but rather that at this location a tight and in most cases an absolutely tight connection exists. It is possibly necessary here to set forth the percentage figures given in the drawings in greater detail so that one will understand which difference exists between the present invention and the previously known method.

There can be set forth a calculated example as follows:

| | | |
|---|---|---|
| Sample Calculation: | Tube measurement | 38 × 3 mm $\phi$ |
| | Bore in the tube wall | 38.4 mm $\phi$ |
| | Wall thickness of tube | 6.0 mm $\phi$ |
| 32.4 mm $\phi$ = theoretical inner diameter upon engagement of tube | | 32.4 mm $\phi$ |
| Plus bonding expansion of 20% of the wall thickness | | + 0.6 mm $\phi$ |
| of the tube in this case 3 mm | | 33.0 mm $\phi$ |

Considering now this example, so there is noted that with the LaPan et al method the inner diameter of the tube equals 32.4 millimeters. This would then be the left rolling-in segment of the pipe or tube 30 according to FIG. 2 of U.S. Pat. No. 3,349,465-LaPan et al. The middle segment would have a somewhat smaller inner diameter of the tube, for example, 32.2 mm, whereas the right segment of the tube would have the normal inner diameter of 32 mm.

With the inventive method, there is noted that the inner diameter is still further enlarged with the rolling-in of the tube and particularly with a bond-widening or spreading out of 20% there is enlargement of the inner diameter to 33 mm. Herein lies accordingly the great difference between the known method and the present inventive method. If this calculation for example were to be transferred onto FIG. 2/II of the present disclosure, so the value at the beginning with 10% of the inner diameter of the tube would be 32.7 mm, in the middle part at 20% the diameter would be rolled upon to a value of 33 mm, whereas in the right part 24 at 10% again an inner diameter of 32.7 mm must be maintained. In the area or range 21 there would then be an inner diameter of 32 mm. The relationship is similar with the other rolling-in examples that can be calculated easily with the foregoing example being readily available. Such a rolling-in, however, is not undertaken with the cited patent and also would not be made obvious even if other patents were attempted to be combined with the LaPan et al disclosure.

In the U.S. Pat. No. 3,449,812-Hauschke et al issued June 17, 1969, there is described only a method with which continuously the tube is to be brought into engagement against the bore wall. There is step for step rolling therewith whereby, however, every step automatically is introduced upon attaining the bond-widening tailored therewith as to the running at the left and after attaining a predetermined time there is again a new step introduced. This has no relationship with the teaching of the present method or in any event would only be related so far as every individual range with the present method can be carried out according to the method of U.S. Pat. No. 3,449,812-Hauschke et al, whereby at a time the then bond-widening that is to occur can have different values. The average man skilled in the art in this field can also then not attain the features of the present invention even if knowing about the disclosures of U.S. Pat. Nos. 3,449,812-Hauschke et al and 3,349,465-La Pan et al because the seal of the pipe in the first mentioned patent only occurs by way of the rolling-in, whereas with the U.S. Pat. No. 3,349,465-La Pan et al the sealing of the pipe always becomes attained by way of a melting connection.

The present invention involves the following:

"Method for differential rolling-in of tubes into plates and walls, especially of heat exchangers, by way of widening or spreading out of the tube section to be rolled in whereby the following steps are carried out:

setting up a program for the widening or spreading out of the tube segment to be rolled in consisting of at least three steps of different tube widening, whereby one step has the normal size of the bond-widening and the other steps have smaller values and the location for rolling in has a length which corresponds to the thickness of the plate or the pipe bottom."

There can also be included the feature that the range with the lowest bond-widening is to be placed toward the inner side of the tube bottom. This would mean accordingly that there are covered the areas 22 and 32 according to FIG. 2. The transition locations between the individual steps occur continuously so that accordingly then in the end effect there is attained a rolling-in corresponding to FIG. 5 and FIG. 6.

In summary, there is stated that it appears there must be comprehended entirely the difference between the engagement of the tubes by way of widening or spreading out and the tight matching of the tubes by way of bond-widening. The greatest difficulty consists particularly therein to understand the steps represented in FIG. 2 of U.S. Pat. No. 3,349,465-La Pan et al even though therein apparently no bond-widening is carried out but rather only there is an engagement of the tube against the bore wall subject to subsequent soldering with the intermediate layer or position 31.

The gap set forth as being between 0.004 through 0.012 inch between the outer wall of the tube and the inner wall of the bore according to U.S. Pat. No. 3,349,465-La Pan et al means that a tight seal is not given or provided. Already in the normal case the tube must be widened or spread out in order to attain this gap since the tube normally has the greater tolerance. With the calculation example having a given tube measurement of 38 mm outer diameter, there results a tolerance between 0.11 and 0.55 mm.

In order to understand clearly, under these circumstances, that a tube rolling-in normally can be subdivided into three individual phases, the following three sub-paragraphs are provided:

a. First the tube is so long widened or spread out until the same engages with its outer wall rigidly against the inner wall of the bore. The bond widening hereby amounts to 0% and normally in this step the same is designated in English with the wording "contact expansion" or "metal-to-metal expansion";

b. The now coming phase with 0.3% bond widening can be designated with the wording "interference fit" with which the tube is still shiftable but certainly is not air-tight or sealed;

c. Now there occurs the tight or seal rolling with at least 5% to a maximum of 35% bond widening which results in a tight expansion or leakproof-rolling as a mechanical joint".

The foregoing (c) is utilized in the present invention, whereas with the La Pan et al patent disclosure at most there is rolling as far as to the sub-paragraph (b).

The foregoing disclosure involves measurement of indication of the bonding expansion respectively the rolling-in of the pipe or tube by way of the roller pressure. As a further criterion for the measurement or indication of the bonding or binding expansion there can be introduced the following considerations. At the location of the momentary rolling-in there arises positively a length expansion respectively stretching of the material. This length expansion respectively the stretching of the material now should be sensed or felt mechanically by way of a feeler, and the result thereof becomes supplied to the previously controlled devices.

The manner of effectiveness of the new method can be summarized to now involve the following features. On the inner side of the tube or pipe bottom there is noted that the pipe or tube becomes rolled only rigidly against the tube bottom in the first step. Thereby there does not yet arise any length expansion since the material can escape or diverge in the direction of the tube bottom. In the second step which overlaps the first step to a certain extent (this is also subsequently set forth with the other steps), there is undertaken the rolling-in of the pipe or tube in the pipe bottom. Thereby there occurs positively a length change of the pipe or tube which moves positively in the direction of the outer surface of the pipe bottom since the pipe is already rigidly connected with the pipe bottom by way of the first step. The inductive measuring feeler at the head end is arranged with the pipe or tube to be rolled-in, and the same thereby monitors the length expansion that arises or occurs. When there is attained a previously set intended value or when a measuring device indicates this actual value, so the drive motor of the roller becomes reversed; this means the motor becomes switched back, and the next step can be in the direction of the pipe bottom outer surface whereby, as already previously stated, the individual steps partially overlap each other so that a satisfactory seal or tightness is provided. The rolling-in respectively the bonding expansion can provide thereby a continuous value or a changing value, and this thereby becomes indicated simultaneously or inscribed by way of an electrical fast or quick writing means.

FIG. 3 has been clarified to illustrate the measuring feeler at the pipe end and connected directly with the control device.

Thus the present invention involves a method for measurement of bonding expansion during material expansion while sealingly rolling-in pipes in a pipe bottom especially for heat exchangers by way of expanding the tube segment to be rolled closely into place. The foregoing is characterized thereby that the tight rolling of the tube occurs in several individual steps beginning with the first step at the pipe bottom inner side whereby during the first step the pipe presses tightly against the pipe bottom without bonding expansion; during the subsequent steps by means of bonding expansion the pipe is connected with the pipe bottom in a tight seal that is no longer releasable; with every rolling step there is sensed or felt the pipe length change brought about from the material displacement, and such sensing occurs by way of an inductive measuring feeler on the face surface of the pipe; upon attaining a previously adjusted actual flow value, the roller motor becomes turned off, reversed, and the next step becomes introduced.

The foregoing method is further characterized thereby that the length change and thereby the attained bonding expansion of the pipe becomes indicated by way of an electrical fast inscribing means during the roller procedure of a roller step. The foregoing method becomes further characterized thereby that the magnitude of the bonding expansion is adjustable in a range from a low value as far as to a high value with respect to the same or a different low value. Apparatus for carrying out the foregoing method is characterized thereby that one controlling means is provided which is adjustable for measurement of the bonding expansion continually or in a step during the rolling-in procedure. The foregoing apparatus is further characterized thereby that with electrical drive machines a multiplicity of settings of every bonding expansion having adjustment members in the controller means provided therewith can be sensed automatically during the rolling. The apparatus according to the foregoing is further characterized thereby that a single adjustment member is connected or provided for the setting of the bonding expansion with a motor, for instance a step-switch motor, which adjusts a predetermined set program correspondingly to adjust the adjustment member during the rolling with an adjustable speed.

The foregoing apparatus is further characterized thereby that for automatically carrying out the roller procedure both a manually changeable and also for example by way of stored information in perforated or magnetic tape an adjustable coding exists for facing the following:

a. the number of preselectable torques for the roller stretch or distance;
b. the number of rolling steps for each torque;
c. the torque upon the previously determined step as well as the indication for the number of prescribed roller steps by way of illuminated writing or inscription and finally a grasping of the carried-out roller steps in a storage means and a registration of the roller steps carried out by way of a measurement writing means or inscription device with which the actual value torque is provided.

It is, of course to be understood that the present invention is, by no means, limited to the showing in the drawings but also comprises any modification within the scope of the appended claims.

I claim:

1. A method of differentially rolling in a tube tightly into a plate, in which the tube has its end inserted in an opening in the plate with its open end at one side of the plate, said tube extending from the opposite side of the plate, said method comprising widening the end of said tube to engage the wall of said aperture, controlling the widening of the end of the tube in said aperture by a program to determine the differential widening of said end, and measuring the elongation of said tube end in said opening to operate the program control of said widening, said program control widening said tube end to bind in the wall of said opening and further widening said end by decreasing its thickness in a region spaced from the side of said plate from which said tube extends, said widening to decrease the thickness of the tube end increasing the binding engagement of the tube in the wall of said opening and causing elongation of said tube end by which said program control is operated.

2. A method in combination according to claim 1, in which the magnitude of the widening of the tube segment to be rolled-in is during the rolling-in process varied in continuous transition from a minimum value to a maximum value and subsequently to a value lower than said maximum value.

3. A method in combination according to claim 2, in which the magnitude of widening of the tube section to be rolled-in is a minimum at the inner side of the wall into which the tube segment is to be rolled-in.

4. A method in combination according to claim 1, according to which the variation in the magnitude of widening of the tube segment to be rolled-in is effected in steps.

5. An apparatus for differentially rolling-in a tube into plates and walls, especially of heat exchangers, according to which the tube section to be rolled-in is widened, which includes in combination roller means adapted to be introduced into the tube section to be flow expanded, driving means operatively connected to said roller means for actuating the same, and control means operatively connected to said driving means for controlling the latter with regard to the measurement of length of the tube section produced by rolling-in movement of said roller means, said control means including measuring means responsive to elongation of said tube section by said roller means, said roller means widening said tube section to decrease the thickness of said tube, so that said tube section is elongated to actuate said control means.

6. An apparatus in combination according to claim 5, in which said driving means are electric driving means, and in which said control means include a plurality of adjusting elements corresponding in number to the number of the respective different diameters of the expanded tube sections to be generated in the tube to be rolled-in, said adjusting elements being adapted to be actuated automatically during the rolling-in operation of said roller means.

7. An apparatus in combination according to claim 5, in which said control means includes means for setting the roller means for stepwise widening of the tube segment, signaling means being respectively associated with the respective steps for indicating the respective step being worked.

8. An apparatus in combination according to claim 7, in which said control means also include repeat switch means respectively associated with the step control means for selectively repeating the same step successively a plurality of times.

9. An apparatus in combination according to claim 5, in which said control means includes a single control element, and a stepping motor operatively connected to said control element and operable to adjust said control element in conformity with a predetermined program.

10. An apparatus in combination according to claim 9, which includes storing means and recording means, and in which said control means include coding means for determining the number of preselectable torques for the rolling-in, for the number of rolling steps for each torque, and for the torque in conformity with the predetermined step, for the indication of the rolling-in steps to be performed, the ascertainment of the carried out rolling steps in said storing means, and the registration in said recording means of the respective rolling step with the actual value of the torque.

11. A method for measurement of adherence enlargement by way of material expansion arising during tight rolling-in of tubes in a tube bottom especially for heat exchangers through widening of tube segments to be rolled-in, comprising in combination steps of seal-rolling the tube in several individual increments beginning with the first step along the tube bottom inner side pressing the tube securely against the tube bottom without adherence enlargement and being connected during subsequent steps by way of adherence enlargement sealing unreleaseably with the tube bottom, and sensing tube length change by way of an inductive measuring feeler means only as to tube material flow displacement caused on the face side of the tube during every rolling-in step and upon attaining a pre-set intended flow value turning off the roller motor, reversing the same and introducing the next step.

12. A method in combination to claim 11 in which there is a step of inscribing length change and thereby the attained adherence enlargement of the tube by way of an electrical fast writing means during rolling procedure for a rolling step.

13. A method in combination according to claim 12 in which there is adjusting of the magnitude of adherence enlargement from a low value over to a highest value and back to the same and optionally to a different low value.

14. In an apparatus for control of enlargement of a tube by rolling in of the tube in a tube bottom through widening of the tube segment which is rolled in, comprising motor-operated roller means for seal rolling the tube segment in increments beginning along the tube bottom inner side from which the tube extends, so as to press the tube against the tube bottom, controller means including means sensing the length of the tube segment being rolled in and having an inductive measuring feeler means, which upon attaining a preset flow value operates to turn off the motor operating the roller means, and reverses the motor, so that said controller means is actuated by said measuring feeler means when said tube segment is pressed into tight engagement with said tube bottom and is decreased in thickness to provide such tight engagement, thereby extending its length.

15. Apparatus in combination according to claim 14 in which there are provided electrical drive machines having multiple adjustment members in said controller means serving on the basis of the adjustment as to every adherence enlargement, and means for automatically sensing with said members during the rolling.

16. Apparatus in combination according to claim 15 in which there is a single adjustment member connected for setting the adherence enlargement with a motor such as a step-switch motor which adjusts the adjustment member with variable speed during the rolling in accordance with a predetermined program.

17. Apparatus in combination according to claim 15 in which there is a coding means both manually changeable and adjustable by way of order-information storage for automatically carrying out the roller procedure to establish:

a. the number of preselectable torques for the roller stretch;

b. the number of rolling steps for each torque;

c. the torque upon the predetermined step as well as an indication by way of illuminated writing for the number of roller steps; and a grasping of the roller steps carried out and held in a storage means and a registration of the enumerated roller steps by way of a measurement inscription means being provided with the actual-value torque.

* * * * *